US005730015A

United States Patent [19]

Leumi

[11] Patent Number: 5,730,015

[45] Date of Patent: Mar. 24, 1998

[54] EXPLOSIVE DEVICE FOR MAKING NOISE COMBINED WITH A KEYCHAIN

[76] Inventor: Dove Leumi, c/o Zipi Behir, 437 Golden Isles Dr. #7F, Hallandale, Fla. 33009

[21] Appl. No.: 616,530

[22] Filed: Mar. 19, 1996

[51] Int. Cl.[6] ..... A44B 15/00

[52] U.S. Cl. ..... 70/456 R; 446/398; 109/34; 109/32

[58] Field of Search ..... 70/456 R, 459; 446/398, 400, 405; D3/207, 208, 209, 210, 211; 109/33, 34, 32

[56] References Cited

U.S. PATENT DOCUMENTS

| | | | |
|---|---|---|---|
| D. 251,755 | 5/1979 | Patience . | |
| D. 324,954 | 3/1992 | Lewis . | |
| 609,994 | 8/1898 | Meyer | 109/36 |
| 701,238 | 5/1902 | Williams | 292/61 |
| 836,313 | 11/1906 | Fox | 292/175 |
| 1,206,933 | 12/1916 | Simonds et al. . | |
| 1,262,012 | 4/1918 | Bull | 109/36 |
| 1,352,624 | 9/1920 | Polcek | 292/175 |
| 1,718,995 | 7/1929 | Barnard | 292/175 |
| 3,139,697 | 7/1964 | Mier | 446/401 |
| 3,225,490 | 12/1965 | Ostrom | 446/405 |
| 3,676,945 | 7/1972 | Neanhouse | 109/33 |
| 3,889,601 | 6/1975 | Koehne et al. | 109/36 |
| 5,018,449 | 5/1991 | Eidson, II | 446/401 |
| 5,206,445 | 4/1993 | Comley et al. | 42/105 |
| 5,438,555 | 8/1995 | Kim . | |

FOREIGN PATENT DOCUMENTS

| | | | |
|---|---|---|---|
| 61894 | 1/1891 | United Kingdom | 109/36 |
| 487103 | 6/1938 | United Kingdom | 446/400 |
| 731877 | 6/1955 | United Kingdom | 109/34 |

*Primary Examiner*—Darnell M. Boucher

[57] ABSTRACT

An explosive device for making noise combined with a keychain comprises a barrel having a bore formed therein accommodating a blank. The device also has a pin disposed in the bore of the barrel and a spring surrounding the periphery of the pin. A ring member connects with the pin. The device makes noise by manually moving the ring member between a first and a second position. The ring member rests against a stop in the barrel remote from the blank in the first position. The ring member releases from the stop, permitting the pin to strike the blank in the barrel under force of the spring, in the second position.

8 Claims, 3 Drawing Sheets

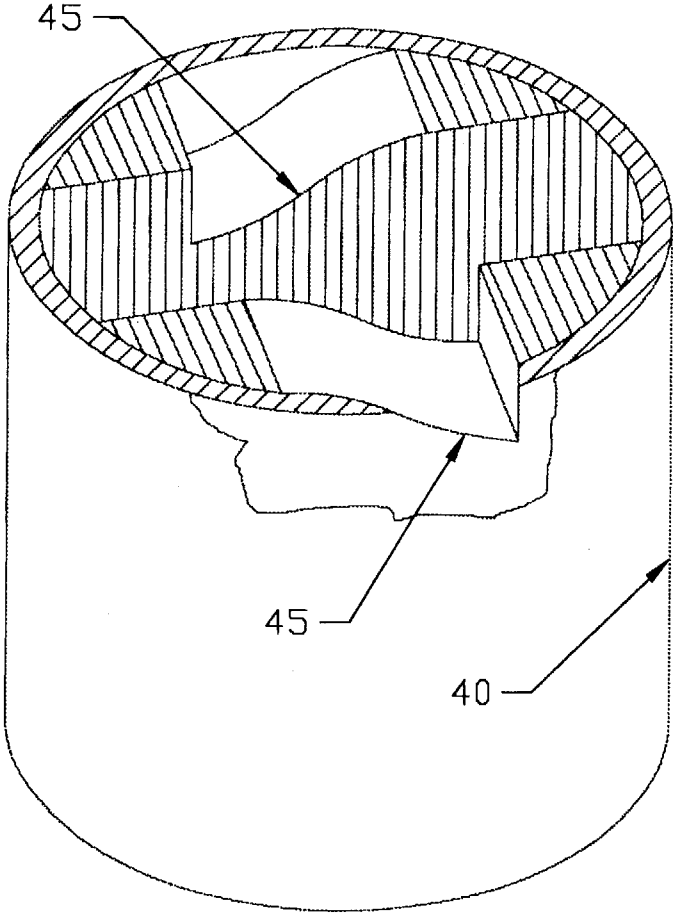
Fig 5
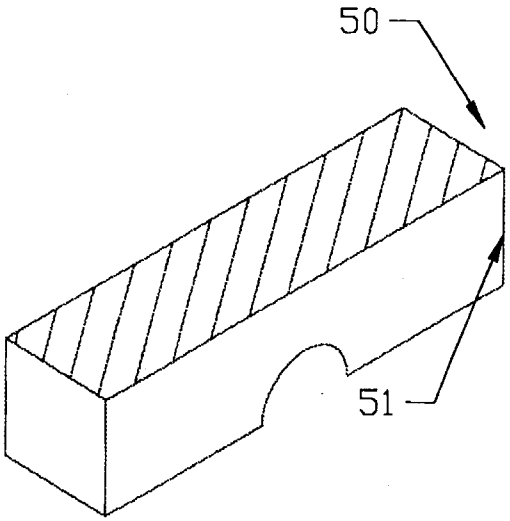
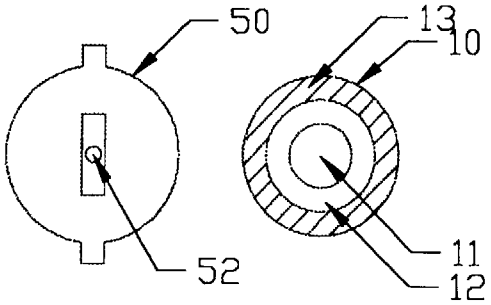
Fig 7
Fig 6

EXPLOSIVE DEVICE FOR MAKING NOISE COMBINED WITH A KEYCHAIN

BACKGROUND OF THE INVENTION

1. Field of the Invention

The invention relates to an explosive device for making noise adaptable for use with a keychain.

2. Description of the Related Art

Various devices are known for scaring a potential attacker and attracting attention to a situation, which are intended to stop the attack of a victim. Such devices include whistles and mace.

One problem with such devices is that the victim must remember to carry the device with them. Consequently, such devices have been combined with keychains, because people normally have keys with them. An example of such a noise making device combined with a keychain is disclosed in U.S. Design Pat. No. 251,755.

It is also known generally to combine small objects with a keychain. For example, a multi-purpose key ring is disclosed in U.S. Pat. No. 5,438,555. A locator device combined with a keychain is disclosed in U.S. Design Pat. No. 324,954. Further, U.S. Pat. No. 1,206,933 discloses a device to make the sound of an animal depicted on the device combined with a keychain.

Another problem with such devices is that they do not produce sounds loud enough to attract attention because people at a distance do not hear them. Also, people often do not associate an attack situation with the sound produced, so no help is sought. Additionally, these devices do not frighten the attacker into stopping the attack.

SUMMARY OF THE INVENTION

It is accordingly an object of the invention to provide an explosive device for making noise combined with a keychain, which overcomes the above-mentioned disadvantages of the heretofore-known devices and methods of this general type and which produce a loud noise associated with danger to frighten an attacker.

With the foregoing and other objects in view there is provided, in accordance with the invention, in combination with a keychain, an explosive device for making noise comprising: a barrel having a bore formed therein to accommodate a blank and having a stop remote from the blank; a pin having a periphery and being disposed in the bore of the barrel; a spring disposed around the periphery of the pin; and a ring member connected to the pin, the ring member being manually movable between a first position and a second position, the ring member resting against the stop and the pin being remote from the blank in the first position, and the ring member being released from the stop and the pin striking the blank under force of the spring in the second position.

In accordance with an added feature of the invention, the stop in the barrel includes two seats.

In accordance with an additional feature of the invention, each of the seats has a vertical side wall and a sloped side wall for facilitating movement of the ring member between the first and the second positions.

In accordance with another feature of the invention, the pin has a threaded end, the ring member has an internally threaded bore formed therein, and the threaded end of the pin threads into the internally threaded bore of the ring member.

In accordance with a further feature of the invention, the ring member includes a block for resting against the stop in the first position and a ring to be manually turned for moving the ring member between the first position and the second position and accommodating a keychain.

In accordance with a again an added feature of the invention, the barrel includes a first hollow member and a second hollow member.

In accordance with again an additional feature of the invention, the first hollow member has an internally threaded end and the second hollow member has a threaded end for threading into the internally threaded end of the first hollow member.

In accordance with again another feature of the invention, the barrel has a ledge formed thereon in the bore and the pin has a head, the head of the pin compressing the spring and resting against the ledge when the ring member is in the first position.

Other features which are considered as characteristic for the invention are set forth in the appended claims. Although the invention is illustrated and described herein as embodied in an explosive device for making noise combined with a keychain, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWING

FIG. 5 is a partially broken away, perspective, fractional view of the second hollow member of the noisemaking keychain along with a perspective, fractional view of a ring member;

FIG. 6 is a front-elevational view of the ring member of the noisemaking keychain;

FIG. 7 is a cross-sectional view of a first hollow member of the noisemaking keychain, which is taken along the line VII—VII of FIG. 1 in the direction of the arrows.

DESCRIPTION OF THE PREFERRED EMBODIMENTS

Figure 1:
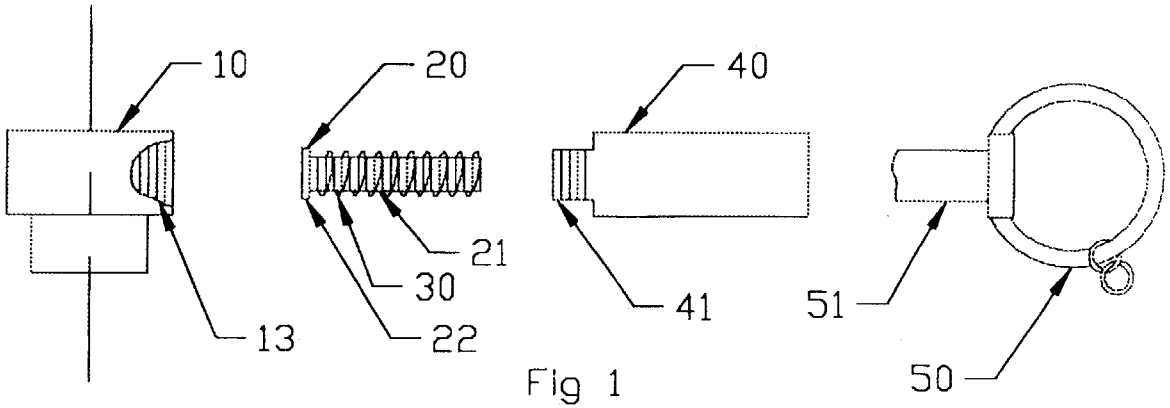
FIG. 1 is a diagrammatic, exploded, partially broken away side-elevational view of a noisemaking keychain according to the invention.

Referring now to the figures of the drawing in detail and first, particularly, to FIG. 1 thereof, there is seen a noisemaking keychain according to the invention which includes five basic parts, namely a first hollow member 10, a pin 20, a spring 30, a second hollow member 40 and a ring member 50. FIG. 1 also shows several features of the five basic parts. The second hollow member 40 has a threaded end 41 that threads into an internally threaded end 13 of the first hollow member 10. The ring member 50 has a block 51 which is inserted into the second hollow member 40 during assembly. In addition, the pin 20 has a head 22 and a threaded end 21 for securing the pin 20, the spring 30, the second hollow member 40 and the ring member 50 together.

The noisemaking keychain is assembled first by placing the spring 30 around the periphery of the threaded end 21 of the pin 20. Then, the pin 20 and the spring 30 are inserted into the second hollow member 40.

As shown in FIG. 7, the first hollow member 10 has a nonuniform bore 11 formed therein. The nonuniform bore 11 forms a ledge 12 within the first hollow member 10. The first hollow member 10 is also provided with an internally threaded end 13 of the nonuniform bore 11. The threaded end 41 of the second hollow member 40 threads into the internally threaded end 13 of the first hollow member 10; permitting the second hollow member 40 to be connected with the first hollow member 10. The first hollow member 10 and the second hollow member 40 form a barrel when connected.

Figure 3:
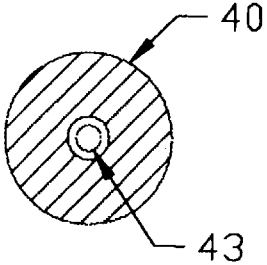
FIG. 3 is a cross-sectional view of the second hollow member of the noisemaking keychain, which is taken along the line III—III of FIG. 2 in the direction of the arrows.
Figure 2:
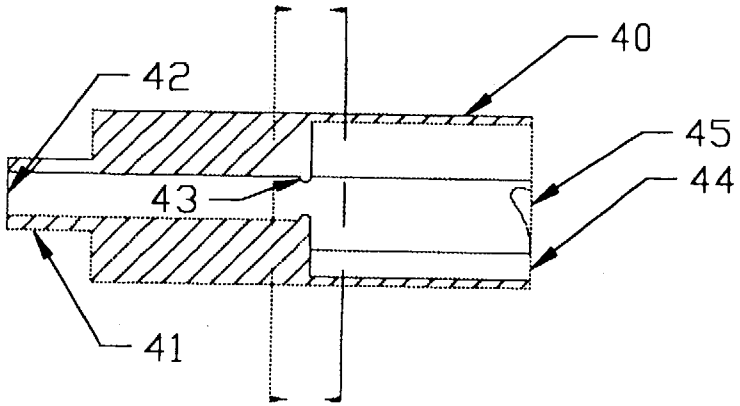
FIG. 2 is a longitudinal-sectional view of a second hollow member of the noisemaking keychain.

As shown in FIG. 2, the second hollow member 40 is also provided with a nonuniform bore 42. The nonuniform bore 42 forms a ledge 43 in the second hollow member 40. The ledge 43 permits the threaded end 21 of the pin 20 to pass completely through the second hollow member 40. However, the ledge 43 stops the spring 30 from passing through the second hollow member 40 and also stops the head 22 of the pin 20 from passing through the second hollow member 40. Another view of the ledge 43 in the second hollow member 40 is shown in FIG. 3.

Figure 4:
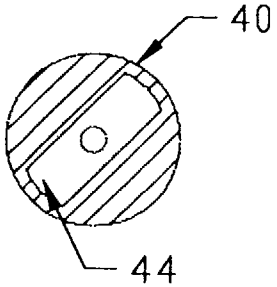
FIG. 4 is a cross-sectional view of the second hollow member of the noisemaking keychain, which is taken along the line IV—IV of FIG. 2 in the direction of the arrows.

As shown in FIGS. 2 and 4, the nonuniform bore 42 in the second hollow member 40 has a rectangular end 44. The rectangular end 44 of the nonuniform bore 42 in the second hollow member 40 has seats 45 shown in FIG. 5. Together the seats 45 of the second hollow member 40 form a stop. The ring member 50 is in a first or cocked position when the block 51 of the ring member 50 rests on seats 45 of the second hollow member 40. The ring member 50 is in the second or fired position when the block 51 of the ring member 50 protrudes into the rectangular end 44 of the nonuniform bore 42 of the second hollow member 40 past the seats 45 and rests against the ledge 43 of the second hollow member 40. An exploded view of the second or fired position of the ring member 50 with respect to the second hollow member 40 is shown in FIG. 5. If the ring member 50 is turned in the direction of the arrows 1 of FIG. 5, the ring member 50 moves to the first or cocked position with respect to the second hollow member 40.

The block 51 of the ring member 50 has a threaded bore 52 formed therein, as seen in FIG. 6. The pin 20, the spring 30, the second hollow member 40 and the ring member 50 are securely connected together during assembly by threading the threaded end 21 of the pin 20 in the threaded bore 52 of the ring member 50.

Figure 8:
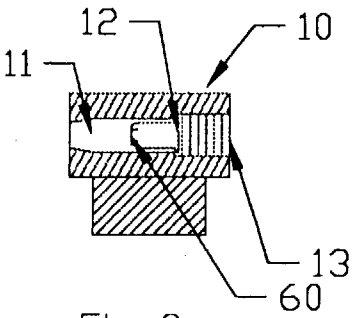
FIG. 8 is a longitudinal-sectional view of a first hollow member of the noisemaking keychain.

The keychain makes noise when a blank 60 is placed in the first hollow member 10 so that the ledge 12 prevents the blank from passing completely through the first hollow member 10, as seen in FIG. 8. The blank 60 is of the type normally used in starter pistols, etc. The first hollow member 10 is then connected to the second hollow member 40 as described above. The ring member 50 is initially in the second or fired position described above. The keychain is then cocked to make noise by retracting the ring member 50 from the rectangular end 44 of the bore 42 of the second hollow member 40 against the force of the spring 30, which also retracts the pin 20 from the blank 60 in the first hollow member 10. The ring member 50 is then turned in the direction of the arrows 1 of FIG. 5 so that the block 51 sits on the seats 45 of the second hollow member 40 in the first or cocked position. Noise is created when the ring member 50 is turned in the opposite direction of the arrows 1 of FIG. 5 so that the block 51 slips back into the bore 42 of the second hollow member 40, returning the ring member 50 to the second or fired position. This action thrusts the pin 20 against the blank 60 with the force of the spring 30, creating a noise.

I claim:

1. In combination with a keychain, an explosive device for making noise, comprising:

a barrel having a bore formed therein to accommodate a blank, a ledge for preventing the blank from passing completely through said bore, and a stop remote from the blank;

a pin having a periphery and being disposed in said bore of said barrel;

a spring disposed around said periphery of said pin; and a ring member integrally connected and movable with said pin, said ring member and pin being manually movable between a first position and a second position, said ring member resting against said stop and said pin being remote from the blank in said first position, and said ring member being released from said stop and said pin striking the blank under force of said spring in said second position.

2. The explosive device according to claim 1, wherein said stop in said barrel includes two seats.

3. The explosive device according to claim 2, wherein each of said seats has a vertical side wall and a sloped side wall for facilitating movement of said ring member between said first and said second positions.

4. The explosive device according to claim 1, wherein said pin has a threaded end, said ring member has an internally threaded bore formed therein, and said threaded end of said pin threads into said internally threaded bore of said ring member.

5. The explosive device according to claim 1, wherein said ring member includes a block for resting against said stop in said first position-and a ring to be manually turned for moving said ring member between said first position and said second position and accommodating a keychain.

6. The explosive device according to claim 1, wherein said barrel is cylindrical in shape and includes a first hollow member and a second hollow member.

7. The explosive device according to claim 6, wherein said first hollow member has an internally threaded end and said second hollow member has a threaded end for threading into said internally threaded end of said first hollow member.

8. The explosive device according to claim 1, wherein said barrel has a ledge formed thereon in said bore and said pin has a head, said head of said pin compressing said spring and resting against said ledge when said ring member is in said first position.

* * * * *